US011017938B2

(12) United States Patent
Navarro et al.

(10) Patent No.: US 11,017,938 B2
(45) Date of Patent: May 25, 2021

(54) METHODS, APPARATUS AND SYSTEMS FOR DRY-TYPE TRANSFORMERS

(71) Applicants: Siemens Aktiengesellschaft, München (DE); Hainan Jinpan Smart Technology Co. Ltd, Haikou (CN)

(72) Inventors: Martin Alsina Navarro, Jundiai (BR); Yaoqiang Wang, Wuhan (CN); Andre Luiz Moreno, Varzea Paulista (BR); Ming Zhang, Wuhan (CN); Xiong Yu, Wuhan (CN)

(73) Assignees: SIEMENS ENERGY GLOBAL GMBH & CO. KG, Munich (DE); HAINAN JINPAN SMART TECHNOLOGY CO. LTD, Hainan (CN)

( * ) Notice: Subject to any disclaimer, the term of this patent is extended or adjusted under 35 U.S.C. 154(b) by 0 days.

(21) Appl. No.: 16/976,655

(22) PCT Filed: Mar. 8, 2018

(86) PCT No.: PCT/CN2018/078427
§ 371 (c)(1),
(2) Date: Aug. 28, 2020

(87) PCT Pub. No.: WO2019/169605
PCT Pub. Date: Sep. 12, 2019

(65) Prior Publication Data

US 2020/0411230 A1 Dec. 31, 2020

(51) Int. Cl.
*H01F 27/32* (2006.01)
*H01F 27/29* (2006.01)
(Continued)

(52) U.S. Cl.
CPC ..... *H01F 27/29* (2013.01); *H01F 27/2885* (2013.01); *H01F 27/32* (2013.01); *H01F 41/12* (2013.01)

(58) Field of Classification Search
USPC ..... 336/84 C
See application file for complete search history.

(56) References Cited

U.S. PATENT DOCUMENTS 4,504,811 A * 3/1985 Stunzi ..... H01H 15/08 200/11 TC
6,806,803 B2 * 10/2004 Hopkinson ..... H01F 27/306 336/12
(Continued)

FOREIGN PATENT DOCUMENTS

CN 202796367 U 3/2013
CN 203085327 U 7/2013
CN 205016360 U 2/2016

OTHER PUBLICATIONS

PCT International Search Report and Written Opinion dated Dec. 3, 2018 corresponding to PCT Application No. PCT/CN2018/078427 filed Mar. 8, 2018.
(Continued)

*Primary Examiner* — Ronald Hinson

(57) ABSTRACT

In some embodiments, a connection bar is provided for connecting multiple high voltage coils of a dry-type transformer along a top or bottom of the dry-type transformer. The connection bar includes (1) an electrically insulating body having a plurality of openings, each opening sized to receive at least one of high voltage terminals of the transformer; (2) an electrical connection pathway within the electrically insulating body configured to create a predetermined electrical connection between multiple high voltage coils of the transformer; (3) external connector terminals embedded within and extending from the electrically insu-
(Continued)

lating body, the external connector terminals connected to the electrical connection pathway; and (4) a ground shield embedded within the electrically insulating body and configured to shield high voltage terminals of each high voltage coil of the transformer. Numerous other aspects are provided.

24 Claims, 10 Drawing Sheets

(51) Int. Cl.
*H01F 27/28* (2006.01)
*H01F 41/12* (2006.01)

(56) References Cited

U.S. PATENT DOCUMENTS 7,834,736 B1* 11/2010 Johnson ..... H01F 27/022 336/229
2005/0040924 A1* 2/2005 LaBoube ..... H01F 27/085 336/5
2011/0248808 A1* 10/2011 Singh ..... H01F 27/327 336/5
2012/0126923 A1 5/2012 Navarro et al.
2013/0113597 A1* 5/2013 Roy ..... H01F 27/36 336/84 C
2013/0113598 A1* 5/2013 Murillo ..... H01F 27/36 336/84 C
2014/0118101 A1 5/2014 Navarro
2015/0109090 A1* 4/2015 Patel ..... H01F 27/36 336/84 C

OTHER PUBLICATIONS

"Transforming difficult installations into perfect solutions. Siemens Transformers."; Published by and copyright © 2010: Siemens AG Energy Sector; Freyeslebenstrasse 1, 91058 Erlangen, Germany.
"Transforming superior technology into reliable quality."; Published by and copyright © 2012: Siemens AG Energy Sector; Freyeslebenstrasse 1, 91058 Erlangen, Germany.
"Transforming perfect planning into outstanding performance."; Published by and copyright © 2012: Siemens AG Energy Sector; Freyeslebenstrasse 1, 91058 Erlangen, Germany.
"Convincing technology creates compact performance"; Published by and copyright © 2014: Siemens AG Energy Sector; Freyeslebenstrasse 1, 91058 Erlangen, Germany.
"Transforming know-how into top technology all round"; Published by and copyright © 2014: Siemens AG Energy Sector; Freyeslebenstrasse 1, 91058 Erlangen, Germany.
"Transforming know-how into success. Siemens Transformers."; Published by and copyright © 2011: Siemens AG Energy Sector; Freyeslebenstrasse 1, 91058 Erlangen, Germany.

* cited by examiner

METHODS, APPARATUS AND SYSTEMS FOR DRY-TYPE TRANSFORMERS

FIELD

This application relates generally to transformers used for electric power distribution, and more particularly to methods, apparatus and systems for dry-type transformers.

BACKGROUND

Transformers are employed to increase or decrease voltage levels during electrical power distribution. To transmit electrical power over a long distance, a transformer may be used to raise the voltage and reduce the current of the power being transmitted. A reduced current level reduces resistive power losses from the electrical cables used to transmit the power. When the power is to be consumed, a transformer may be employed to reduce the voltage level, and increase the current, of the power to a level required by the end user.

One type of transformer that may be employed is a dry, submersible transformer, as described, for example, in U.S. Pat. No. 8,614,614. Such transformers may be employed underground, in cities, etc., and may be designed to withstand harsh environments such as water exposure, humidity, pollution and the like. Improved methods, apparatus and systems for submersible and other dry-type transformers are desired.

SUMMARY

In some embodiments, a connection bar is provided for connecting multiple high voltage coils of a dry-type transformer along a top or bottom of the dry-type transformer. The connection bar includes (1) an electrically insulating body sized to extend across high voltage terminals of multiple high voltage coils of the transformer, the electrically insulating body having a plurality of openings that extend into the electrically insulating body, each opening sized to receive at least one of the high voltage terminals of a respective one of the high voltage coils of the transformer; (2) an electrical connection pathway within the electrically insulating body, the electrical connection pathway extending between the plurality of openings and configured to create a predetermined electrical connection between multiple high voltage coils of the transformer; (3) external connector terminals embedded within and extending from the electrically insulating body, the external connector terminals connected to the electrical connection pathway; and (4) a ground shield embedded within the electrically insulating body and configured to shield high voltage terminals of each high voltage coil of the transformer.

In some embodiments, a dry-type transformer includes (1) a plurality of high voltage coils, each including two high voltage terminals positioned at a top or bottom of the high voltage coil; (2) a connection bar positioned to extend across the plurality of high voltage coils, the connection bar including: (3) an electrically insulating body sized to extend across the high voltage terminals of the high voltage coils of the transformer, the electrically insulating body having a plurality of openings that extend into the electrically insulating body, each opening sized to receive at least one of the high voltage terminals of a respective one of the high voltage coils of the transformer; (4) an electrical connection pathway within the electrically insulating body, the electrical connection pathway extending between the high voltage terminals within the plurality of openings so as to create a predetermined electrical connection between the multiple high voltage coils of the transformer; and (5) external connector terminals embedded within and extending from the electrically insulating body, the external connector terminals connected to the electrical connection pathway.

In some embodiments, a method is provided of forming a dry-type transformer. The method includes (1) providing a plurality of high voltage coils, each including two high voltage terminals positioned at a top or bottom of the high voltage coil; (2) providing a connection bar including (a) an electrically insulating body sized to extend across the high voltage terminals of the high voltage coils of the transformer, the electrically insulating body having a plurality of openings that extend into the electrically insulating body, each opening sized to receive at least one the high voltage terminals of a respective one of the high voltage coils of the transformer; (b) an electrical connection pathway within the electrically insulating body, the electrical connection pathway extending between the high voltage terminals within the plurality of openings so as to create a predetermined electrical connection between the multiple high voltage coils of the transformer; and (c) external connector terminals embedded within and extending from the electrically insulating body, the external connector terminals connected to the electrical connection pathway. The method further includes (3) positioning the connection bar so that each high voltage terminal of each high voltage coil is positioned within a respective opening of the plurality of openings in the electrically insulating body; and (4) coupling each high voltage terminal of each high voltage coil to the electrical connection pathway.

In some embodiments, a method is provided of forming a connection bar for connecting multiple high voltage coils of a dry-type transformer along a top or bottom of the transformer. The method includes (1) forming an electrically insulating body sized to extend across high voltage terminals of multiple high voltage coils of the transformer, the electrically insulating body having a plurality of openings that extend into the electrically insulating body, each opening sized to receive at least one of the high voltage terminals of a respective one of the high voltage coils of the transformer; (2) forming an electrical connection pathway within the electrically insulating body, the electrical connection pathway extending between the plurality of openings and configured to create a predetermined electrical connection between multiple high voltage coils of the transformer; (3) forming external connector terminals embedded within and extending from the electrically insulating body, the external connector terminals connected to the electrical connection pathway; and (4) forming a ground shield embedded within the electrically insulating body and configured to shield high voltage terminals of each high voltage coil of the transformer.

Still other aspects, features, and advantages of this disclosure may be readily apparent from the following detailed description illustrated by a number of example embodiments and implementations. This disclosure may also be capable of other and different embodiments, and its several details may be modified in various respects. Accordingly, the drawings and descriptions are to be regarded as illustrative in nature, and not as restrictive. The drawings are not necessarily drawn to scale.

DETAILED DESCRIPTION

Figure 1A:
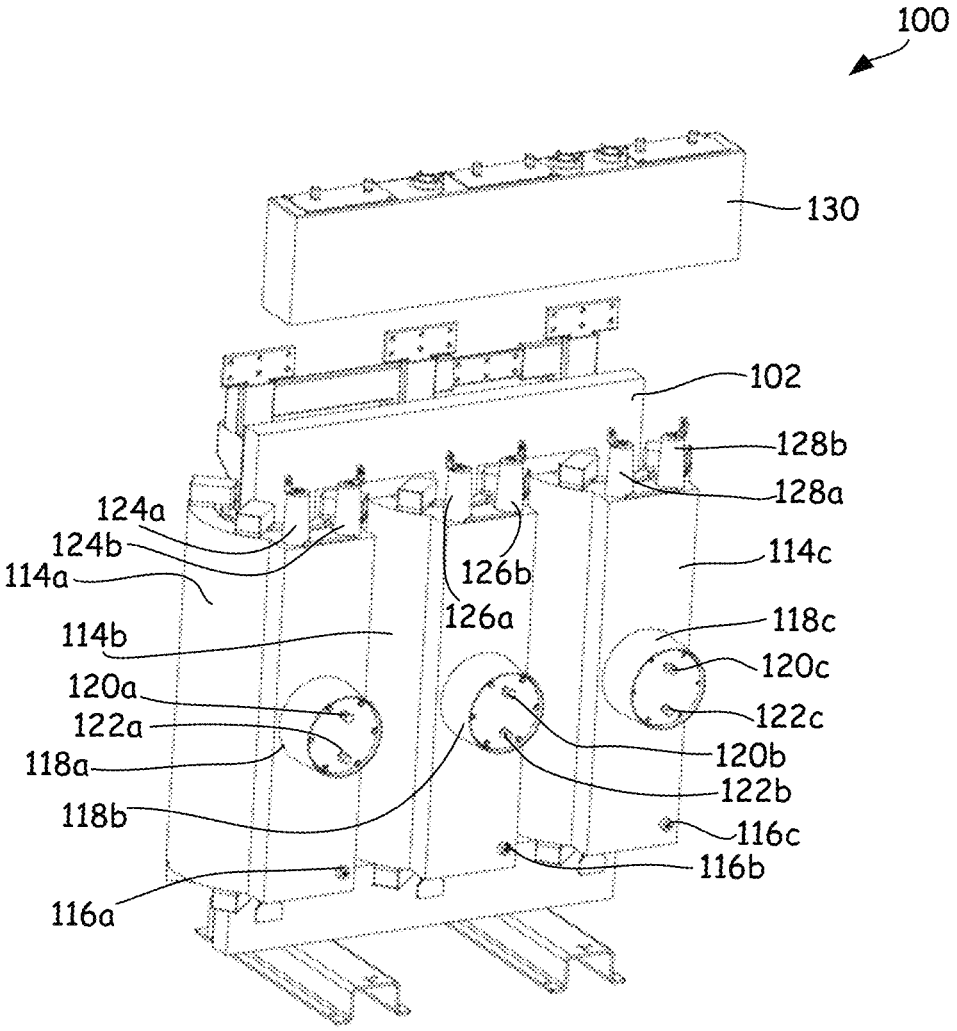
FIG. 1A is a side perspective view of a submersible dry-type transformer in accordance with embodiments provided herein.

As mentioned above, submersible dry-type transformers may be employed underground and/or in other environments that may expose the transformers to water, humidity, pollutants, etc. Such transformers are often connected to deliver multiple phases of electrical power, such as 2-phase, 3-phase or more phases. Common 3-phase configurations include, for example, delta and wye connected transformers.

Conventional delta connections for submersible dry-type transformers are made on a front side of the transformers. For example, each high voltage coil of a transformer may have two high voltage terminals which protrude from the front side of the transformer, and multiple cables (e.g., three) may be fastened to the protruding terminals to create the delta connection between the high voltage coils. Wye or other connections may be similarly created using the protruding external high voltage terminals.

Use of high voltage terminals and cable connections on a front side of the transformer increases the footprint of the transformer. For example, the terminals and cables of a delta-connected transformer may be the most (laterally) external features of the transformer. If such a transformer is subjected to a side impact, whether from an external object, maintenance personnel, or the like, the high voltage terminals and/or cables may be damaged. Damage to the functionality of the transformer may result, such as damage to the high voltage terminals, insulation of the transformer or cables, etc. Damage to the cables and/or transformer insulation may expose individuals in the vicinity of the transformer to potentially lethal voltage and/or currents.

In accordance with one or more embodiments described herein, submersible dry-type transformers are provided that have high voltage terminals located above or below the transformers, rather than on a front side of the transformers. In some embodiments, high voltage coils of a submersible dry-type transformer are connected, such as in a delta or wye configuration, through use of a connection bar located at a top of or below the transformer. The connection bar replaces the need for multiple individual cables and moves the connections between high voltage terminals of a transformer from a front side of the transformer to a top side of or below the transformer. The connection bar may be formed from an insulating material, such as an epoxy resin, that protects and/or isolates the electrical connections between high voltage coils from external environments, including impacts. Likewise, maintenance or other personnel are isolated and/or protected from the electrical connections between the high voltage terminals of the coils.

Placing the high voltage terminals above or below the transformer, and using the connecting bar for creating multiple coil connections (e.g., delta and/or wye connections), reduces the overall footprint of the transformer. The transformer is less susceptible to damage from side impacts, and safer for maintenance personnel. Manufacturing costs also may be reduced as shielding of the transformer is simplified by elimination of the front side high voltage terminals.

FIG. 1A is a side perspective view of a submersible dry-type transformer 100 in accordance with embodiments provided herein. The transformer 100 shown is a three-phase transformer, but in other embodiments, transformers with different number of phases may be employed (e.g., one, two, four, five, etc.).

Figure 1B:
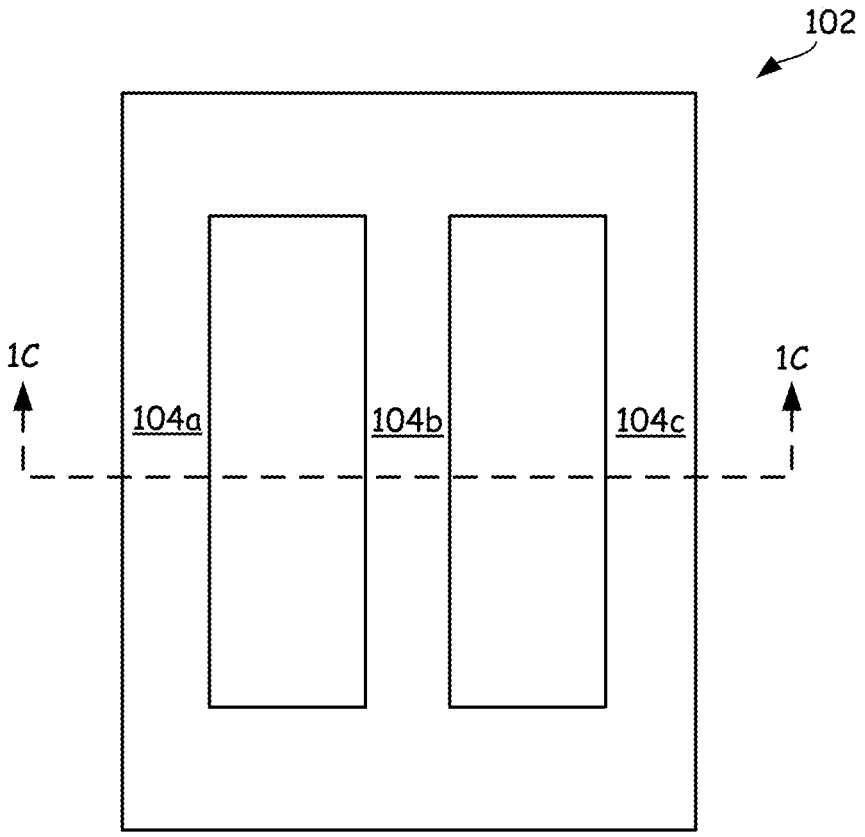
FIG. 1B is a side view of a core in accordance with embodiments provided herein.
Figure 1C:
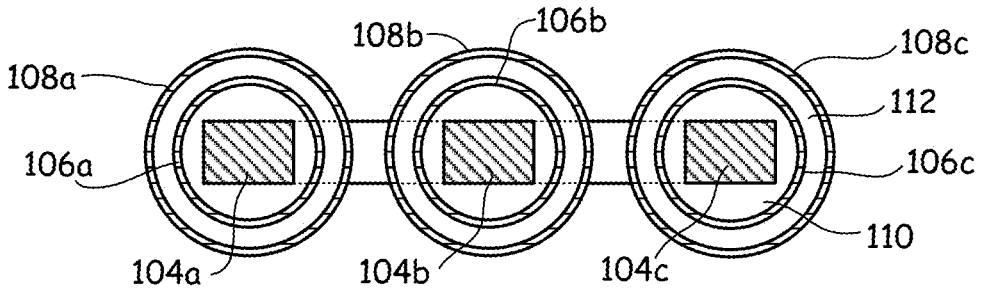
FIG. 1C is a cross sectional view of the core of FIG. 1B taken along line 1C-1C in FIG. 1B.

Transformer 100 includes a core 102. FIG. 1B is a side view of core 102, and FIG. 1C is a cross sectional view of core 102 taken along line 1C-1C in FIG. 1B. Core 102 may be a solid core or a core formed from multiple sheets of core materials. Example core materials include iron, steel, amorphous steel or other amorphous metals, silicon-steel alloy, carbonyl iron, ferrite ceramics, laminated layers of one or more of the above materials, or the like.

As shown in FIG. 1B, core 102 includes core columns 104*a*, 104*b* and 104*c*. In some embodiments, within transformer 100, each core column 104*a*, 104*b* and 104*c* is surrounded by a low voltage coil 106*a-c* and a high voltage coil 108*a-c*, which may be concentric. Note that coils may also be referred to as windings. Low voltage coils 106*a-c* may be electrically isolated from core 102 and from high voltage coils 108*a-c*. For example, low voltage coils 106*a-c* may be surrounded by an insulating material such as a resin (not shown) and high voltage coils 108*a-c* may have insulating material (e.g., resin) and shielding (not shown) on both sides of the high voltage coils 108*a-c*. In some embodiments, a first space 110 between the core 102 (core columns 104*a-c*) and low voltage coils 106*a-c* may have air, water or both. Similarly, a second space 112 between the low voltage coils 106*a-c* and high voltage coils 108*a-c* may have air, water or both. Example insulating materials include a solid insulation, such as an epoxy resin, polyurethane, polyester, silicone, etc. An example epoxy resin is a synthetic rubber such as polybutadiene, for example, High Gel Re-Enterable Encapsulant 8882 available by 3M of St. Paul, Minn.

Referring again to FIG. 1A, the high voltage coils 108*a-c* (FIG. 1C) are surrounded by transformer housings 114*a-c*. Transformer housings 114*a-c* may be formed from any suitable material, such as a metal (e.g., aluminum), and are electrically isolated from high voltage coils 108*a-c* using a solid insulation (not shown) such as epoxy resin, polyurethane, polyester, silicone, or the like, for example. Transformer housings 114*a-c* may be electrically grounded via grounding connections 116*a-c*.

In some embodiments, each transformer housing 114*a-c* may include a window 118*a-c*, respectively, through which one or more of the insulations provided between core 102, low voltage coils 106*a-c*, high voltage coils 108*a-c* and/or housings 114*a-c* may be inserted, removed and/or replaced. For example, each housing window 118*a-c* may include an upper inlet 120*a-c* and a lower inlet 122*a-c*. During resin filling, vacuum may applied to one inlet, such as an upper inlet, while resin is provided to the other inlet, such as the lower inlet. Application of vacuum withdraws air from any area that will receive insulation and prevents the formation of air bubbles as the insulation fills the intended area. Formation of air bubbles may result in electrical discharge when the coils are energized. Insulation insertion and/or removal processes are described, for example, in U.S. Patent Application Publication No. US 2014/0118101 A1, which is hereby incorporated by reference herein in its entirety for all purposes. Additional details regarding an example submersible dry-type transformer that may be employed in accordance with one or more embodiments provide herein is described in previously mentioned U.S. Pat. No. 8,614,614, which is hereby incorporated by reference herein in its entirety for all purposes. In some embodiments, windows 118*a-c* may also provide access to adjustable taps (not shown) of the coils of transformer 100.

Referring again to FIG. 1A, transformer housing 114*a* is provided with high voltage terminals 124*a*, 124*b* positioned on top of the housing 114*a*. Likewise, transformer housing 114*b* is provided with high voltage terminals 126*a*, 126*b* positioned on top of the housing 114*b*; and transformer housing 114*c* is provided with high voltage terminals 128*a*, 128*b* positioned on top of the housing 114*c*. The high voltage terminals 124*a-b*, 126*a-b* and 128*a-b* provide electrical connections to high voltage coils 108*a-c*, respectively (FIG. 1C). As described further below with reference to FIGS. 2A-9, a connection bar 130 may be employed to interconnect high voltage terminals 124*a-b*, 126*a-b* and 128*a-b*, and thus high voltage coils 108*a-c*, in any desired configuration (e.g., a delta connection, a wye connection, etc.). In other embodiments, described below with reference to FIGS. 8A-8B, the high voltage terminals 124*a-b*, 126*a-b* and 128*a-b* may be positioned below each transformer housing 114*a-c* and connection bar 130 may be employed to interconnect high voltage terminals 124*a-b*, 126*a-b* and 128*a-b*, and thus high voltage coils 108*a-c*, in any desired configuration (e.g., a delta connection, a wye connection, etc.).

Figure 2A:
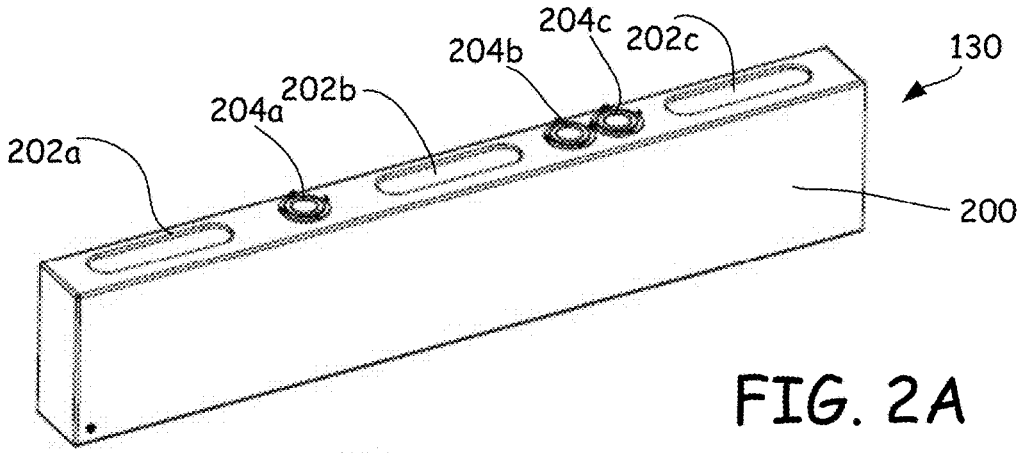
FIGS. 2A and 2B are top and bottom perspective views, respectively, of a first example embodiment of a connection bar provided herein.
Figure 2B:
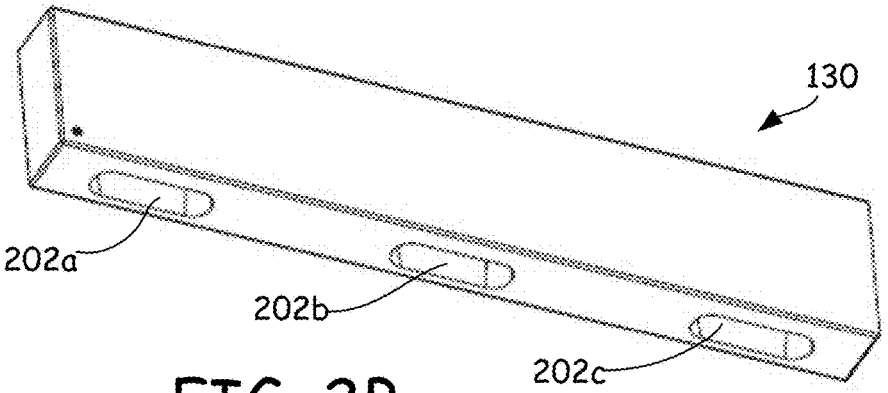

FIGS. 2A and 2B are top and bottom perspective views, respectively, of a first example embodiment of connection bar 130 provided herein. With reference to FIG. 2A, connection bar 130 includes an electrically insulating body 200 sized to extend across high voltage terminals of multiple high voltage coils of a submersible dry-type transformer. For example, connection bar 130 may extend across high voltage terminals 124*a-b*, 126*a-b* and 128*a-b* of transformer 100 of FIG. 1A.

Electrically insulating body 200 has a plurality of openings 202*a-c* that extend into the electrically insulating body 200, each opening sized to receive at least one of the high voltage terminals 124*a-b*, 126*a-b* and 128*a-b* of a respective one of the high voltage coils 108*a-c* of the submersible dry-type transformer 100. In some embodiments, electrically insulating body 200 may have a separate opening for each high voltage terminal of transformer 100 (e.g., six openings for a three-phase transformer that employs two high voltage terminals per coil). In other embodiments, electrically insulating body 200 may have an opening for each set of high voltage terminals of transformer 100 (e.g., three openings for a three-phase transformer that employs two high-voltage terminals per coil). In yet other embodiments, other numbers of openings may be employed.

Electrically insulating body 200 may be formed from any suitable insulating material. In some embodiments, electrically insulating body 200 may be formed from an epoxy resin, polyurethane, polyester, silicone, or the like. Other materials may be employed. Example resins include Aradur® HY 926 CH and/or Araldite® CY 5948 available from Huntsman Quimica Brasil Ltda. of Sao Paulo, Brasil.

As will be described further below, electrically insulating body 200 may include an electrical connection pathway within electrically insulating body 200. The electrical connection pathway may extend between the plurality of openings 202*a*-202*c* and be configured to create a predetermined electrical connection between multiple high voltage coils 108*a-c* of submersible dry-type transformer 100.

External connector terminals 204*a-c* may be embedded within and/or extend from one or more surfaces of the electrically insulating body 200. For example, in some embodiments, external connector terminals 204*a-c* may extend from a top surface of electrically insulating body 200, as shown in FIG. 2A, while in other embodiments described below, one or more external connector terminals may extend from a side surface of electrically insulating body 200. As will be described below, in some embodiments, external connector terminals 204*a-c* may be connected to an electrical connection pathway between openings 202*a-c* and high voltage terminals 124*a-b*, 126*a-b* and 128*a-b*. Connectors 206*a-c*, such as plug-in connectors, may be provided to facilitate connection of external connector terminals 204*a-c* to electrical cables, as shown, for example, in FIG. 2C.

Figure 2C:
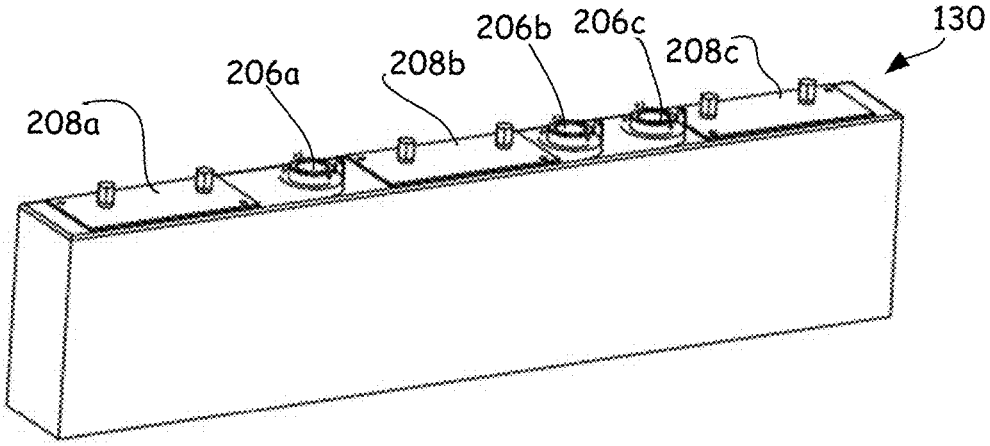
FIG. 2C is another top perspective view of the first example embodiment of the connection bar of FIGS. 2A-2B provided herein.

In the embodiment of FIGS. 2A-C, openings 202*a-c* are formed in a top surface of electrically insulating body 200 and extend through to a bottom side of electrically insulating body 200 as shown in FIGS. 2A and 2B. In other embodiments described below, openings 202*a-c* may only extend a portion of the way into electrically insulating body 200. In the embodiment of FIGS. 2A-C, a top cover 208*a*, 208*b* and 208*c* is provided for each opening 202*a*, 202*b* and 202*c*, respectively. Top covers 208*a*-208*c* may be formed from any suitable material. In some embodiments, top covers 208*a*-208*c* are formed from a metal such as aluminum, copper, a semi-conductive resin, a conductive foil or mesh, etc., and are grounded (e.g., to provide electrical shielding from high voltage terminals 124*a-b*, 126*a-b* and 128*a-b*).

Figure 3A:
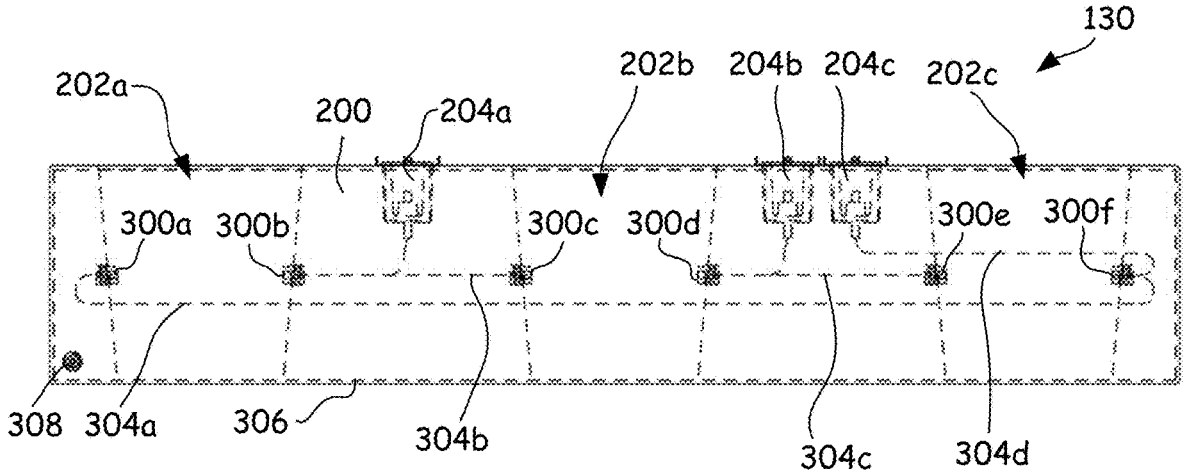
FIGS. 3A and 3B are a side view and top view, respectively, of an example embodiment of the connection bar of FIGS. 2A-2C provided herein.
Figure 3B:
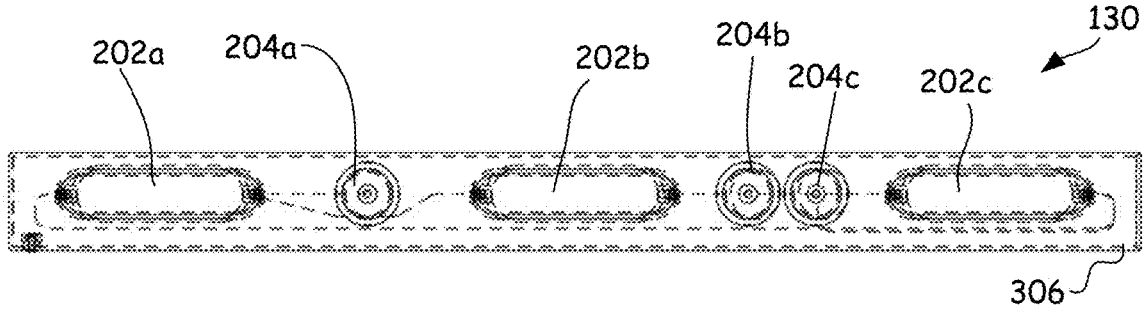

FIGS. 3A and 3B are a side view and top view, respectively, of an example embodiment of the connection bar 130 of FIGS. 2A-2C provided herein. With reference to FIG. 3A, in some embodiments, openings 202*a-c* are tapered so that a top of each opening is wider than a bottom of the opening. Such a design may facilitate removal of the mold during casting of the electrically insulating body 200. For example, the sidewalls of the openings 202*a-c* may be tapered at an angle of about 10 to 20 degrees, and in some embodiments about 15 degrees, relative to vertical. Other taper angles may be employed.

As further shown in FIG. 3A, in some embodiments, openings 202*a-c* have internal connectors 300*a*-300*f* for making electrical contact with high voltage terminals 124*a-b*, 126*a-b* and 128*a-b*. For example, internal connector 300*a* may couple to high voltage terminal 124*a*, internal connector 300*b* may couple to high voltage terminal 124*b*, internal connector 300*c* may couple to high voltage terminal 126*a*, internal connector 300*d* may couple to high voltage terminal 126*b*, internal connector 300*e* may couple to high voltage terminal 128*a*, and internal connector 300*f* may couple to high voltage terminal 128*b*. In such an embodiment, to form an example delta connection between high voltage coils 108*a-c*, a first electrical connection pathway 304*a* extends between internal connectors 300*a*, internal connector 300*f* and external connector terminal 204*c*; a second electrical pathway 304*b* extends between internal connector 300*b*, internal connector 300*c* and external connector terminal 204*a*; a third electrical pathway 304*c* extends between internal connector 300*d*, internal connector 300*e* and external connector terminal 204*b*. Each electrical pathway 304*a-c* is embedded within electrical insulating body 200 (e.g., during casting of the material used to form electrical insulating body 200). In some embodiments, internal electrical connectors 300*a-f* and/or electrical pathways 304*a-c* may be formed from copper, aluminum or another conductive material. Other materials may be used.

Electrical insulating body 200 may include an embedded ground shield 306 that extends proximate all sides of the insulating body 200 and/or around external terminal connectors 204*a-c*. Ground shield 306 may be grounded using a ground connection 308, for example. Ground shield 306 isolates the external surfaces of connection bar 130 from high voltage terminals 124*a-b*, 126*a-b* and 128*a-b* and provides a safer environment for maintenance personnel. Ground shield 306 may be caste within electrical insulating body 200 during formation, and in some embodiments may be formed from aluminum, copper, semi-conductive paint, semi-conductive resin, a metal sheet, foil or mesh, or the like, for example. Other ground shield materials may be employed.

Figure 3C:
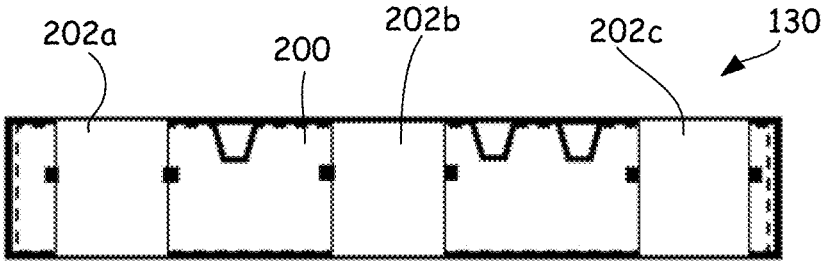
FIG. 3C is a side view of an alternative embodiment of the connection bar of FIGS. 3A-3B in which the openings are not tapered.

FIG. 3C is a side view of an alternative embodiment of connection bar 130 in which openings 202*a*-202*c* are not tapered. In the embodiment of FIG. 3C, each opening 202*a*-202*c* is sized to hold two high voltages terminals. For example, opening 202*a* may hold high voltage terminals 124*a-b*, opening 202*b* may hold high voltage terminals 126*a-b*, and opening 202*c* may hold high voltage terminals 128*a-b*.

Figure 3D:
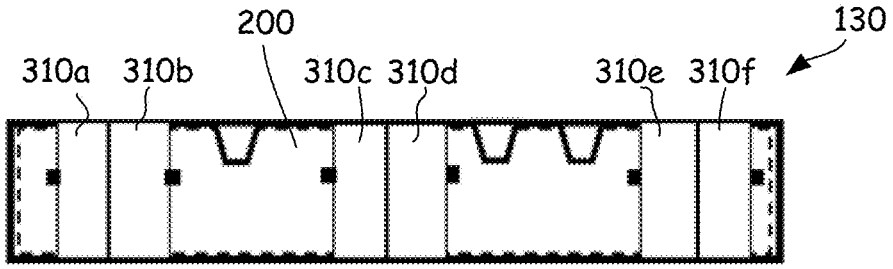
FIG. 3D is a side view of another alternative embodiment of the connection bar of FIGS. 3A-3B in which each high voltage terminal is positioned in a different opening.

FIG. 3D is a side view of another alternative embodiment of connection bar 130 in which each high voltage terminal may be positioned in a different opening. For example, each opening may be sized to hold a single high voltage terminal. In some embodiments, opening 310*a* may hold high voltage terminal 124*a*, opening 310*b* may hold high voltage terminal 124*b*, opening 310*c* may hold high voltage terminal 126*a*, opening 310*d* may hold high voltage terminal 126*b*, opening 310*e* may hold high voltage terminal 128*a* and opening 310*f* may hold high voltage terminal 128*b*. Although not shown as tapered, in some embodiments, all or a portion of one or more of openings 310*a*-310*f* may be tapered (e.g., a top of each opening may be wider than a bottom of each opening). In general other shapes may be employed for the sidewalls of the openings 310*a*-310*f*.

Figure 4A:
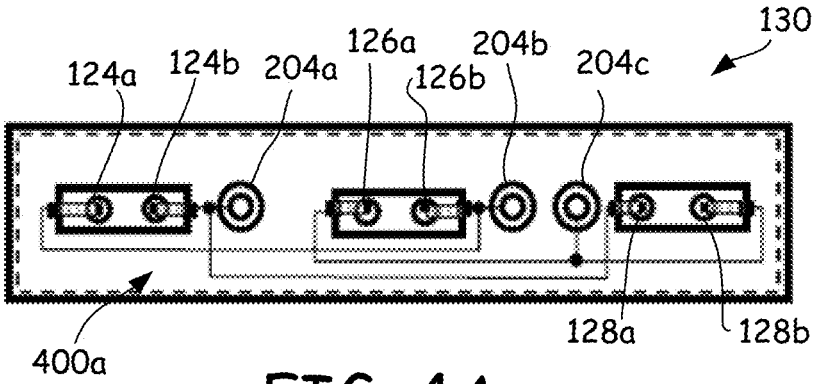
FIGS. 4A and 4B are top schematic views of a connection bar configured to provide a first delta connection in accordance with embodiments herein.
Figure 4B:
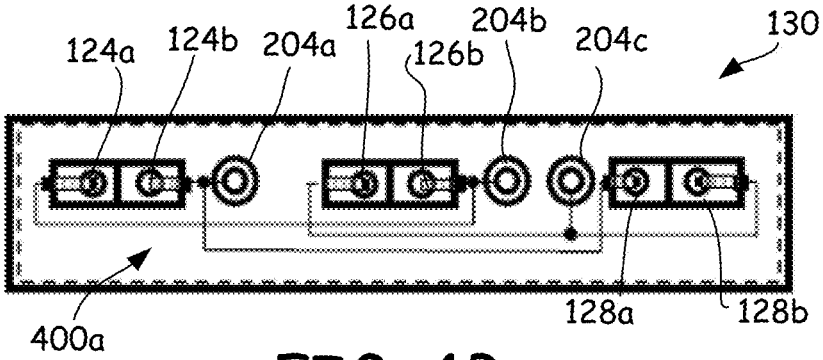

Connection bar 130 may be configured to provide any desired connection between any number of high voltage terminals. FIGS. 4A and 4B are top schematic views of connection bar 130 configured to provide a first delta connection in accordance with embodiments herein. As shown in FIGS. 4A and 4B, high voltage terminals 124*a-b*, 126*a-b* and 128*a-b* and external connector terminals 204*a-c* are configured to form a delta connection (e.g., a delta-wye 1 connection) by electrical connection pathways 400*a* between the terminals. In the embodiment of FIG. 4A, three openings are employed for high voltage terminals 124*a-b*, 126*a-b* and 128*a-b*, while six openings are used in the embodiment of FIG. 4B.

Figure 4C:
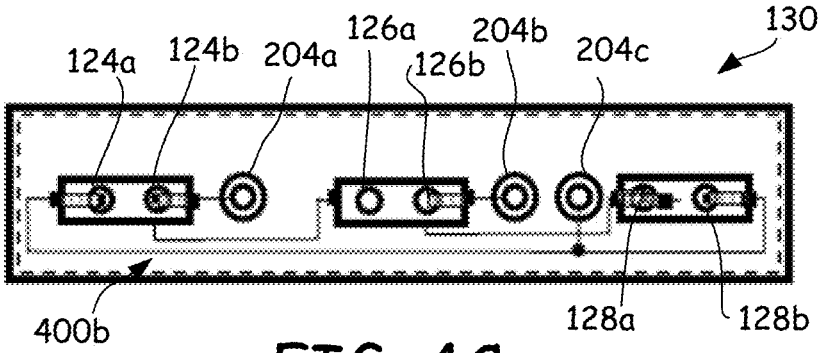
FIGS. 4C and 4D are top schematic views of a connection bar configured to provide a second delta connection in accordance with embodiments herein.
Figure 4D:
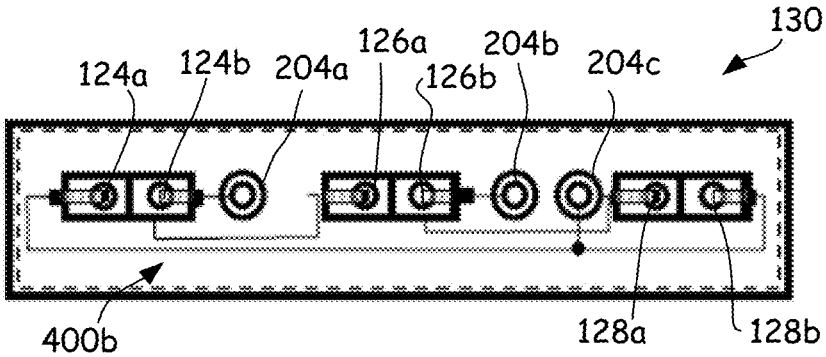

FIGS. 4C and 4D are top schematic views of connection bar 130 configured to provide a second delta connection in accordance with embodiments herein. As shown in FIGS. 4C and 4D, high voltage terminals 124*a-b*, 126*a-b* and 128*a-b* and external connector terminals 204*a-c* are configured to form a delta connection (e.g., a delta-wye 11 connection) by electrical connection pathways 400*b* between the terminals. In the embodiment of FIG. 4C, three openings are employed for high voltage terminals 124*a-b*, 126*a-b* and 128*a-b*, while six openings are used in the embodiment of FIG. 4D.

Figure 5A:
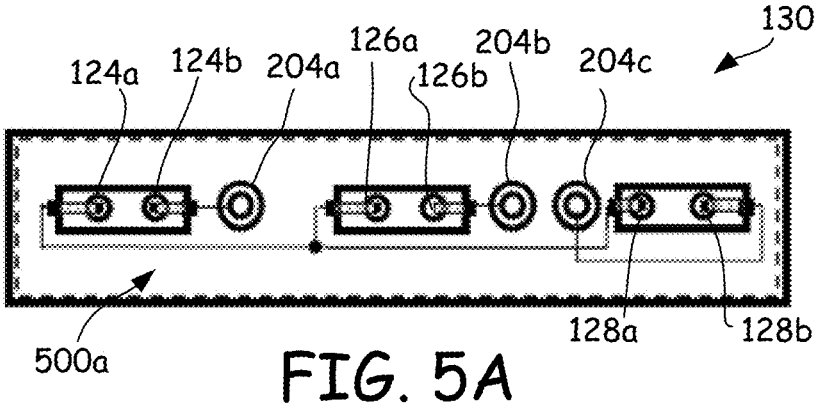
FIGS. 5A and 5B are top schematic views of a connection bar configured to provide a first wye connection in accordance with embodiments herein.
Figure 5B:
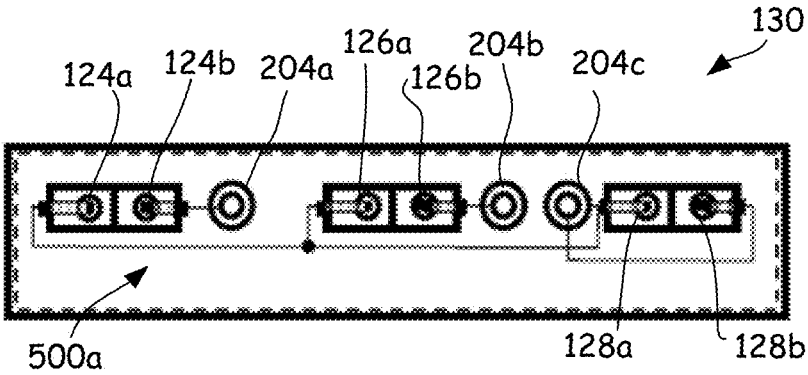

FIGS. 5A and 5B are top schematic views of connection bar 130 configured to provide a first wye connection in accordance with embodiments herein. As shown in FIGS. 5A and 5B, high voltage terminals 124*a-b*, 126*a-b* and 128*a-b* and external connector terminals 204*a-c* are configured to form a wye connection by electrical connection pathways 500*a* between the terminals. In the embodiment of FIG. 5A, three openings are employed for high voltage terminals 124*a-b*, 126*a-b* and 128*a-b*, while six openings are used in the embodiment of FIG. 5B.

Figure 6:
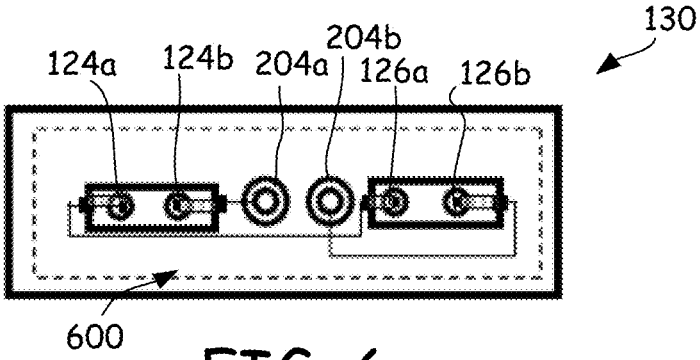
FIG. 6 is a top schematic view of a connection bar configured to provide series connected high voltage coils (e.g., single phase) in accordance with embodiments herein.

FIG. 6 is a top schematic view of connection bar 130 configured to provide series connected high voltage coils (e.g., single phase) in accordance with embodiments herein. As shown in FIG. 6, high voltage terminals 124*a-b* and 126*a-b* are connected in series between external connector terminals 204*a-b* by electrical connection pathways 600 between the terminals. In some embodiments, a separate opening may be used for each high voltage terminal.

In any of the above described embodiments, external connector terminals 204*a*, 204*b* and/or 204*c* may be otherwise located (e.g., anywhere along the top surface, side surface or along multiple surfaces of the connection bar 130).

Figure 7A:
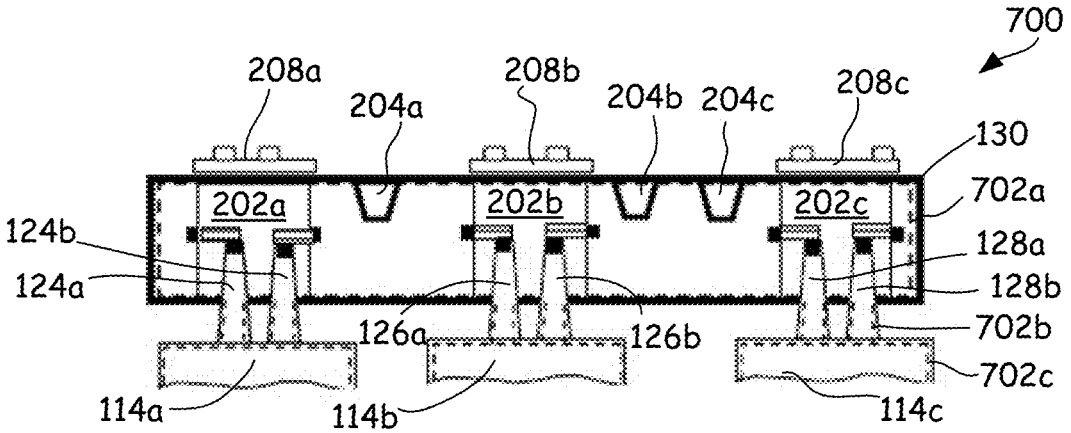
FIG. 7A is a side schematic view of an example embodiment of a three-phase submersible dry-type transformer employing a connection bar as provided herein.

FIG. 7A is a side schematic view of an example embodiment of a three-phase submersible dry-type transformer 700 employing connection bar 130. Transformer 700 includes three encased high voltage coils (within transformer housings 114*a-c*) having high voltage terminals 124*a-b*, 126*a-b* and 128*a-b* on top of the housings 114*a-c*, respectively. High voltage terminals 124*a-b*, 126*a-b* and 128*a-b* are positioned within openings 202*a-c* and are connected to external connector terminals 204*a-c* (e.g., in a delta, wye or other desired connection as provided by electrical pathways within connection bar 130). Once positioned within openings 202*a-c*, high voltage terminals 124*a-b*, 126*a-b* and 128*a-b* are connected electrically to external connector terminals 204*a-c* as previously described, and then are encased in insulation (e.g., epoxy resin, polyurethane, polyester, silicone, or the like). Covers 208*a-c* are then placed over openings 202*a-c* and are electrically grounded.

As shown in FIG. 7A, connection bar 130 includes a ground shield 702*a*, high voltage terminals 124*a-b*, 126*a-b* and 128*a-b* each include a ground shield 702*b*, and transformer housings 114*a-b* each include a ground shield 702*c*. In some embodiments, ground shields 702*a*, 702*b* and 702*c* are electrically coupled. Ground shields 702*a*, 702*b* and 702*c* isolate the environment surrounding transformer 700 from the transformer's high voltage coils, increasing safety of transformer 700 during operation. In some embodiments, ground shields 702*a*, 702*b* and/or 702*c* may be formed from aluminum, copper, semi-conductive paint, semi-conductive resin, a metal sheet, foil or mesh, or the like, for example. Other ground shield materials may be employed.

Figure 7B:
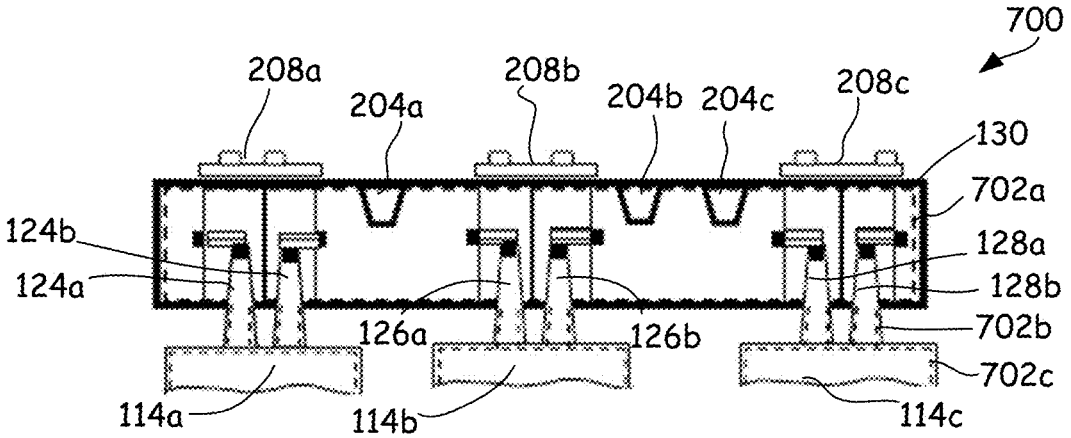
FIG. 7B is a side schematic view of an example embodiment of a three-phase submersible dry-type transformer employing a connection bar with an opening for each high voltage terminal as provided herein.

FIG. 7B is a side schematic view of an example embodiment of a three-phase submersible dry-type transformer 700 employing connection bar 130 with an opening for each high voltage terminal as provided herein.

Figure 7C:
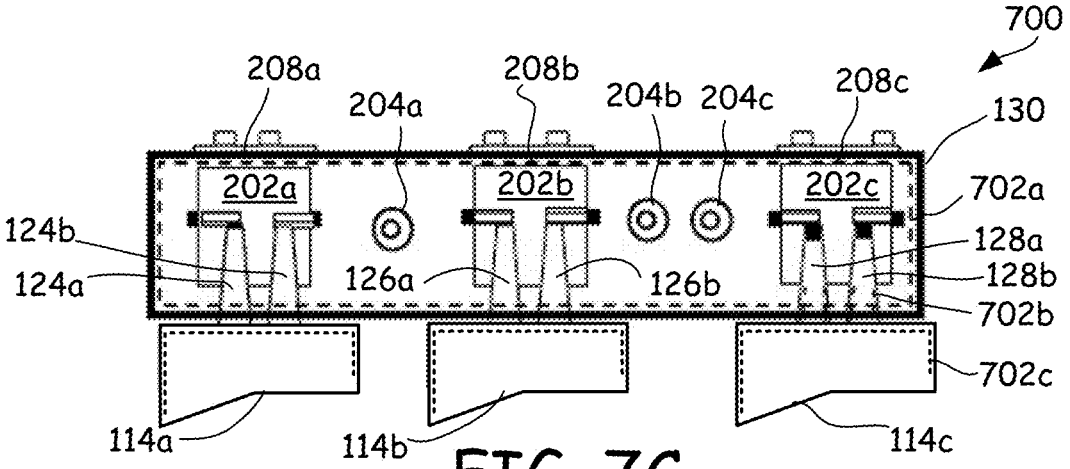
FIG. 7C is a side schematic view of an alternative example embodiment of a three-phase submersible dry-type transformer employing a connection bar as provided herein.

FIG. 7C is a side schematic view of an alternative example embodiment of a three-phase submersible dry-type transformer 700 employing connection bar 130 as provided herein. In the embodiment of FIG. 7C, external connector terminals 204*a-c* are formed in a side surface of connection bar 130 (as opposed to in the top surface of connection bar 130 as shown in FIGS. 7A and 7B).

Figure 8A:
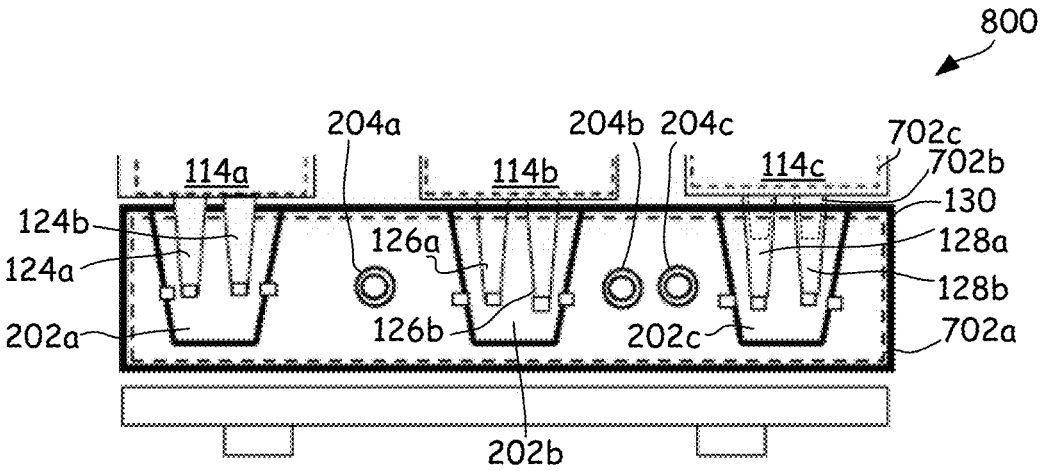
FIGS. 8A and 8B are side schematic views of another example embodiment of a three-phase submersible dry-type transformer employing a connection bar on a bottom of the transformer as provided herein.
Figure 8B:
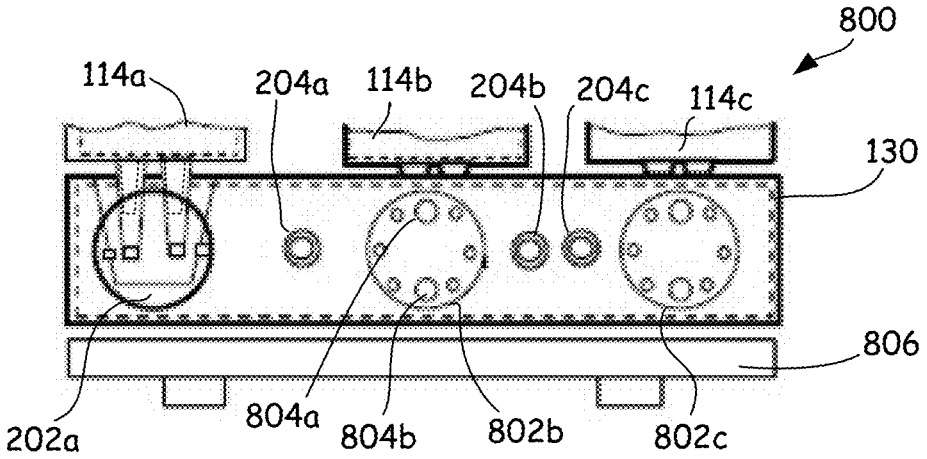

FIGS. 8A and 8B are side schematic views of another example embodiment of a three-phase submersible dry-type transformer 800 employing connection bar 130 on a bottom of transformer 800. Transformer 800 includes three encased high voltage coils (within transformer housings 114*a-c*) having high voltage terminals 124*a-b*, 126*a-b* and 128*a-b* on a bottom of the housings 114*a-c*, respectively. High voltage terminals 124*a-b*, 126*a-b* and 128*a-b* are positioned within openings 202*a-c* and are connected to external connector terminals 204*a-c* (e.g., in a delta, wye or other desired connection as provided by electrical pathways within connection bar 130). External connector terminals 204*a-c* are located on a side of connection bar 130. In some embodiments, covers (only covers 802*b* and 802*c* are shown in FIG. 8B) are then placed over openings 202*a-c* and are electrically grounded. High voltage terminals 124*a*-b, 126*a-b* and 128*a-b* (connected electrically to external connector terminals 204*a-c* as previously described) are encased in insulation (e.g., epoxy resin, polyurethane, polyester, silicone, or the like). For example, each cover 802 may include an upper inlet 804*a* and a lower inlet 804*b*. In some embodiments, vacuum may applied to one inlet, such as upper inlet 804*a*, while resin is provided to the other inlet, such as lower inlet 804*b*. Application of vacuum withdraws air from any area that will receive insulation and prevents the formation of air bubbles as the insulation fills the intended area. Formation of air bubbles may result in electrical discharge when the high voltage terminals are energized. Insulation insertion and/or removal processes are described, for example, in previously incorporated U.S. Patent Application Publication No. US 2014/0118101 A1. An example epoxy resin is a synthetic rubber such as polybutadiene, for example, High Gel Re-Enterable Encapsulant 8882 available by 3M of St. Paul, Minn.

As shown in FIG. 8A, connection bar 130 includes ground shield 702*a*, high voltage terminals 124*a-b*, 126*a-b* and 128*a-b* each include ground shield 702*b*, and transformer housings 114*a-b* each include ground shield 702*c*. In some embodiments, ground shields 702*a*, 702*b* and 702*c* are electrically coupled. Ground shields 702*a*, 702*b* and 702*c* isolate the environment surrounding transformer 800 from the transformer's high voltage coils, increasing safety of transformer 800 during operation. Transformer 800 may be positioned on any suitable support 806.

Figure 9:
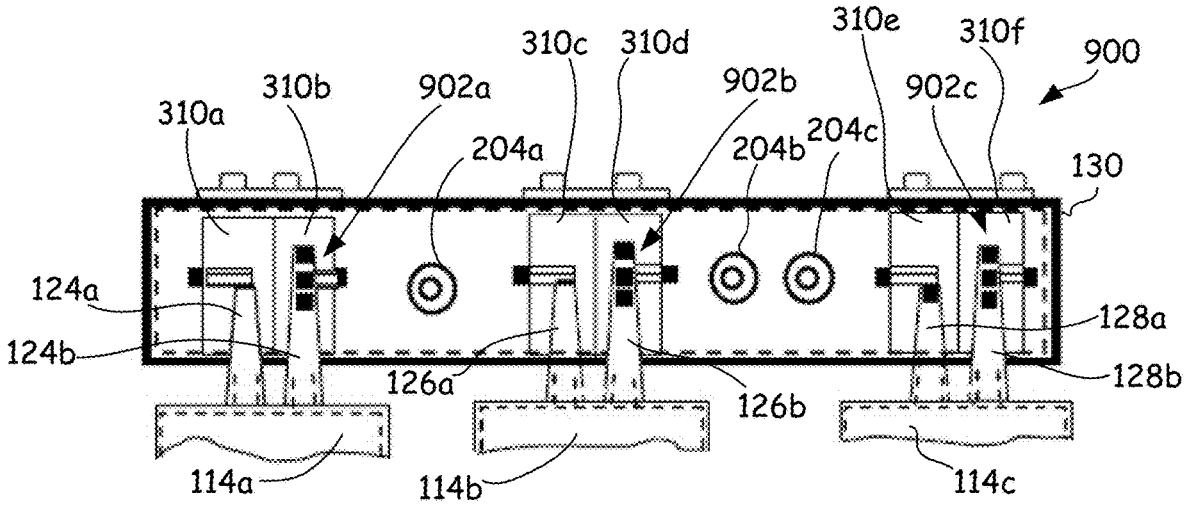
FIG. 9 is a side schematic view of another example embodiment of a three-phase submersible dry-type transformer employing a connection bar and which includes selectable coil taps on high voltage terminals as provided herein.

In some embodiments, one or more of high voltage terminals 124*a-b*, 126*a-b* and 128*a-b* may include one or more coil taps. For example, FIG. 9 is a side schematic view of another example embodiment of a three-phase submersible dry-type transformer 900 employing connection bar 130 and which includes selectable coil taps on high voltage terminals 124*b*, 126*b* and 128*b*. Other configurations may be employed.

With reference to FIG. 9, transformer 900 includes three encased high voltage coils (within transformer housings 114*a-c*) having high voltage terminals 124*a-b*, 126*a-b* and 128*a-b* on a top of the housings 114*a-c*, respectively. High voltage terminals 124*a-b*, 126*a-b* and 128*a-b* are positioned within openings 310*a-f* and are connected to external connector terminals 204*a-c* (e.g., in a delta, wye or other desired connection as provided by electrical pathways within connection bar 130). External connector terminals 204*a-c* are located on a side of connection bar 130.

Each high voltage terminal 124*b*, 126*b* and 128*b* includes three tap locations, identified generally as 902*a*, 902*b* and 902*c*, respectively, to which a connection may be made. In some embodiments, an approximately 10% difference in voltage may be provided between the upper and lower taps of each high voltage terminal 124*b*, 126*b* and 128*b*, for example. Insulation may be provided between each tap to provide electrical isolation therebetween. Other tap configurations may be employed. Such taps may be used with any of the connection bars described herein.

Numerous advantages are provided by the connection bars described herein. One or more of the embodiments provided herein allows connection bar 130 to operate in air or immersed in water (e.g., up to 3 meters of water in some embodiments). Also, the footprint of a transformer is reduced by placing the connection bar 130 above or below the transformer housings 114*a-c*.

Submersible dry-type transformers provided in accordance with embodiments described herein may have lower material costs than other transformer designs. For example, the material cost of connection bar 130 may be lower than the cost of using cables that employ 6 plug-in bushings and 6 plug-in cable terminals. The simplicity of the casting mold and labor time required for producing a connection bar may also reduce costs.

A transformer employing a connection bar 130 has a width defined by the width of the coils, not by cables connected to a side of the transformer. The width dimension of the transformer is important because there are dimension limitations during the installation and transport. For example, a small footprint transformer may be desirable for wind farms or similar space-sensitive applications.

A transformer with a connection bar as described herein may be employed, for example, for applications in wind farms as the high voltage coils are shielded, with plug-in bushings or with bushings for external cables for an overhead distribution network, for outdoor transformer applications, for underground distribution network applications, for high voltage applications (e.g., 36 kV, 69 kV, 72 kV or 110 kV), and/or for any other suitable application.

Placing connection bar 130 above or below a transformer may reduce stress on the transformer by allowing more expansion of the conductors of the transformer's high voltage coils. Heating of the high voltage coils and transformer rating depend on the thermal capability of the transformer to dissipate heat generated by the coils. Placing the connection bar 130 above or below the transformer may increase thermal dissipation of the high voltage coils, reduce warming during operation, and increase the rating of the transformer.

As mentioned, connection bar 130 may be used to form any desired connection including, for example, delta connections of any type (e.g., delta-wye 1, delta-wye 11, etc.), wye connections, single phase series or parallel connections, etc.

In some embodiments, external connector terminals 204*a-c* and/or connectors 206*a-c* may include plug-in bushings such as IEEE 386 connectors.

As mentioned, in some embodiments, connection bar 130 may be manufactured by casting with an epoxy resin or other insulator with a mold, under vacuum, including, for example, connection leads, connection nuts, plug-in bushings, a shielding system, openings for high voltage terminals, etc. In some embodiments, transformer coils may be manufactured by casting coils within an epoxy resin or other insulator with a mold, under vacuum, including windings and insulations, connection leads, connection nuts, a shielding system, taps, etc. Curing may include a thermal process, such as a thermal anneal. In some embodiments, assembly of a dry-type transformer may include placing high voltage terminals in openings of the connection bar; connecting high voltage terminals to electrical pathways in the connection bar (e.g., via conductive bridges, screws, washers, nuts, etc.); closing and sealing the connection bar openings; connecting (grounding) shields, and filling the openings with insulation (e.g., epoxy resin).

In one or embodiments described herein, through use of shielding, connection bar 130 and transformer housings 114*a-c* may be grounded. Further, connection bar 130 and transformer housings 114*a-c* may be submersible.

In some embodiments, high voltage terminals 124*a-b*, 126*a-b* and/or 128*a-b* may have lead conductors cast in insulation, such as a resin. In one or more embodiments, a thickness of the insulation surrounding high voltage terminals 124*a-b*, 126*a-b* and/or 128*a-b* may be largest near the coils, forming a conical shape. Other insulation shapes may be used.

In some embodiments, a method is provided that includes forming a dry-type transformer by (a) providing a plurality of high voltage coils, each including two high voltage terminals positioned at a top or bottom of the high voltage coil; (b) providing a connection bar including an electrically insulating body having a plurality of openings and an electrical connection pathway within the electrically insulating body; (c) positioning the connection bar so that each high voltage terminal of each high voltage coil is positioned within a respective opening of the plurality of openings in the electrically insulating body; and (d) coupling each high voltage terminal of each high voltage coil to the electrical connection pathway.

In some embodiments, a method is provided that includes forming a connection bar for connecting multiple high voltage coils of a dry-type transformer along a top or bottom of the transformer. The method includes (a) forming an electrically insulating body having a plurality of openings (b) forming an electrical connection pathway within the electrically insulating body, the electrical connection pathway extending between the plurality of openings and configured to create a predetermined electrical connection between multiple high voltage coils of the transformer; (c) forming external connector terminals embedded within and extending from the electrically insulating body, the external connector terminals connected to the electrical connection pathway; and (d) forming a ground shield embedded within the electrically insulating body and configured to shield high voltage terminals of each high voltage coil of the transformer.

While the present disclosure is described primarily with regard to submersible dry-type transformers, it will be understood that the disclosed embodiments may also be employed with other dry-type transformers, such as dry-type transformers that operate at high voltage (e.g., 110 kV), dry-type transformers for wind farms, or other dry-type transformers. In some embodiments, a dry-type transformer having shielded coils, with grounded shielding, may employ a connector bar as described herein. Such dry-type transformers may or may not be submersible.

The foregoing description discloses only example embodiments. Modifications of the above-disclosed apparatus and methods which fall within the scope of this disclosure will be readily apparent to those of ordinary skill in the art. For example, although the examples discussed above are illustrated for power distribution systems, other embodiments in accordance with this disclosure can be implemented for other markets.

What is claimed is:

1. A connection bar for connecting multiple high voltage coils of a dry-type transformer along a top or bottom of the dry-type transformer comprising:

an electrically insulating body sized to extend across high voltage terminals of multiple high voltage coils of the transformer, the electrically insulating body having a plurality of openings that extend into the electrically insulating body, each opening sized to receive at least one of the high voltage terminals of a respective one of the high voltage coils of the transformer;

an electrical connection pathway within the electrically insulating body, the electrical connection pathway extending between the plurality of openings and configured to create a predetermined electrical connection between multiple high voltage coils of the transformer;

external connector terminals embedded within and extending from the electrically insulating body, the external connector terminals connected to the electrical connection pathway; and a ground shield embedded within the electrically insulating body and configured to shield high voltage terminals of each high voltage coil of the transformer.

2. The connection bar of claim 1 wherein the electrically insulating body includes at least three openings and is configured to receive the high voltage terminals of three high voltage coils of the transformer.

3. The connection bar of claim 1 wherein the electrical connection pathway is configured to form a delta connection between the high voltage coils of the transformer.

4. The connection bar of claim 1 wherein the electrical connection pathway is configured to form a wye connection between the high voltage coils of the transformer.

5. A dry-type transformer comprising:

a plurality of high voltage coils, each including two high voltage terminals positioned at a top or bottom of the high voltage coil;

a connection bar positioned to extend across the plurality of high voltage coils, the connection bar including:

an electrically insulating body sized to extend across the high voltage terminals of the high voltage coils of the transformer, the electrically insulating body having a plurality of openings that extend into the electrically insulating body, each opening sized to receive at least one of the high voltage terminals of a respective one of the high voltage coils of the transformer;

an electrical connection pathway within the electrically insulating body, the electrical connection pathway extending between the high voltage terminals within the plurality of openings so as to create a predetermined electrical connection between the multiple high voltage coils of the transformer; and external connector terminals embedded within and extending from the electrically insulating body, the external connector terminals connected to the electrical connection pathway.

6. The transformer of claim 5 wherein the transformer includes three high voltage coils and three sets of high voltage terminals, each set including two high voltage terminals.

7. The transformer of claim 6 wherein the electrically insulating body includes at least three openings and is configured to receive the high voltage terminals of the three high voltage coils of the transformer.

8. The transformer of claim 5 wherein the electrical connection pathway is configured to form a delta connection between the high voltage coils of the transformer.

9. The transformer of claim 5 wherein the electrical connection pathway is configured to form a wye connection between the high voltage coils of the transformer.

10. The transformer of claim 5 further comprising a ground shield embedded within the electrically insulating body and configured to shield the high voltage terminals of each high voltage coil of the transformer.

11. The transformer of claim 5 wherein each opening of the electrically insulating body is filled with an insulating resin to electrically insulate the high voltage terminals within the openings.

12. The transformer of claim 11 wherein each opening of the electrically insulating body is covered with an electrically conductive cover and is grounded.

13. A method of forming a dry-type transformer comprising:

providing a plurality of high voltage coils, each including two high voltage terminals positioned at a top or bottom of the high voltage coil;

providing a connection bar including:

an electrically insulating body sized to extend across the high voltage terminals of the high voltage coils of the transformer, the electrically insulating body having a plurality of openings that extend into the electrically insulating body, each opening sized to receive at least one the high voltage terminals of a respective one of the high voltage coils of the transformer;

an electrical connection pathway within the electrically insulating body, the electrical connection pathway extending between the high voltage terminals within the plurality of openings so as to create a predetermined electrical connection between the multiple high voltage coils of the transformer; and external connector terminals embedded within and extending from the electrically insulating body, the external connector terminals connected to the electrical connection pathway;

positioning the connection bar so that each high voltage terminal of each high voltage coil is positioned within a respective opening of the plurality of openings in the electrically insulating body; and coupling each high voltage terminal of each high voltage coil to the electrical connection pathway.

14. The method of claim 13 wherein the transformer includes three high voltage coils and three sets of high voltage terminals, each set including two high voltage terminals.

15. The method of claim 14 wherein the electrically insulating body includes at least three openings and is configured to receive the high voltage terminals of the three high voltage coils of the transformer.

16. The method claim 13 wherein the electrical connection pathway is configured to form a delta connection between the high voltage coils of the transformer.

17. The method of claim 13 wherein the electrical connection pathway is configured to form a wye connection between the high voltage coils of the transformer.

18. The method of claim 13 further employing a ground shield embedded within the electrically insulating body to shield the high voltage terminals of each high voltage coil of the transformer.

19. The method of claim 13 further comprising filling each opening of the electrically insulating body with an insulating resin to electrically insulate the high voltage terminals within the openings.

20. The method of claim 19 further comprising covering each opening of the electrically insulating body with an electrically conductive cover and grounding each electrically conductive cover.

21. A method of forming a connection bar for connecting multiple high voltage coils of a dry-type transformer along a top or bottom of the transformer, the method comprising:

forming an electrically insulating body sized to extend across high voltage terminals of multiple high voltage coils of the transformer, the electrically insulating body having a plurality of openings that extend into the electrically insulating body, each opening sized to receive at least one of the high voltage terminals of a respective one of the high voltage coils of the transformer;

forming an electrical connection pathway within the electrically insulating body, the electrical connection pathway extending between the plurality of openings and configured to create a predetermined electrical connection between multiple high voltage coils of the transformer;

forming external connector terminals embedded within and extending from the electrically insulating body, the external connector terminals connected to the electrical connection pathway; and forming a ground shield embedded within the electrically insulating body and configured to shield high voltage terminals of each high voltage coil of the transformer.

22. The method of claim 21 wherein the electrically insulating body includes at least three openings and is configured to receive the high voltage terminals of three high voltage coils of the transformer.

23. The method of claim 21 wherein the electrical connection pathway is configured to form a delta connection between the high voltage coils of the transformer.

24. The method of claim 21 wherein the electrical connection pathway is configured to form a wye connection between the high voltage coils of the transformer.

* * * * *